US005601281A

United States Patent [19]

Kubodera et al.

[11] Patent Number: 5,601,281

[45] Date of Patent: Feb. 11, 1997

[54] AUTOMATIC DOCUMENT FEEDING DEVICE

[75] Inventors: Toshihiro Kubodera; Shuji Ishimaru, both of Yamanashi-ken, Japan

[73] Assignee: NISCA Corporation, Yamanashi-ken, Japan

[21] Appl. No.: 365,698

[22] Filed: Dec. 29, 1994

[30] Foreign Application Priority Data

Dec. 29, 1993 [JP] Japan ..... 5-350136

[51] Int. Cl.[6] ..... B65H 5/06

[52] U.S. Cl. ..... 271/10.04; 271/10.13; 271/114

[58] Field of Search ..... 271/10.04, 10.05, 271/10.09, 10.11, 10.13, 114, 116

[56] References Cited

U.S. PATENT DOCUMENTS

| | | | |
|---|---|---|---|
| 4,248,415 | 2/1981 | Steinhilber | 271/10.13 X |
| 4,638,987 | 1/1987 | Sakurai | 271/116 X |
| 4,721,297 | 1/1988 | Katayama | 271/10.04 |
| 4,722,518 | 2/1988 | Watanabe | 271/10.04 X |
| 4,927,130 | 5/1990 | Tanaka et al. | 271/114 X |
| 5,195,737 | 3/1993 | Ifkovits, Jr. et al. | 271/116 X |

FOREIGN PATENT DOCUMENTS

| | | | |
|---|---|---|---|
| 58-31837 | 2/1983 | Japan . | |
| 60-161844 | 8/1985 | Japan | 271/10.13 |
| 62-5858 | 2/1987 | Japan . | |
| 63-35740 | 3/1988 | Japan . | |

*Primary Examiner*—Karen B. Merritt
*Assistant Examiner*—Scott L. Lowe
*Attorney, Agent, or Firm*—Kane, Dalsimer, Sullivan, Kurucz, Levy, Eisele and Richard LLP

[57] ABSTRACT

A document feed roller and registering rollers are driven through first and second one-way clutches so that the feed roller connected to the motor through the first one-way clutch is driven to forward a document to be processed only when the motor rotates in a positive direction, and the registering rollers connected to the motor through the second one-way clutch are driven to perform skew-correction and forward the document only when the motor rotates in a negative direction. The document is transported for a first part of a document feeding passage by the feed roller and for a second part of the passage by the registering rollers with efficiency merely by switching the rotational direction of the motor.

11 Claims, 7 Drawing Sheets

AUTOMATIC DOCUMENT FEEDING DEVICE

BACKGROUND OF THE INVENTION

1. Field of the Invention

This invention relates to a device for automatically feeding documents to an image processing device such as a copying machine, and more particularly to an automatic document feeding device capable of rationally feeding documents one by one to a document reading portion of the image processing device with efficiency.

2. Description of the Prior Art

An automatic document feeder has been applied widely to a variety of image processing devices such as a copying machine, image reader and facsimile. In the automatic document feeder, the documents stacked on a document supply tray are automatically fed one by one to a document reading portion of the image processing device and extracted from the document reading portion upon completion of a desired processing operation. For example, the copying machine is commonly provided on its top with a transparent platen defining the document reading portion on which the document to be optically read is placed. The document feeder is generally hinged on the top of the copying machine so that it can open upward to manually place the document on the platen.

In general, the document feeding device of this type has a document feeding passage extending from the document supply tray to the document reading portion defined on the platen, along which a plurality of rollers including at least one document draw-out roller (kick roller) for sending out the documents on the document supply tray one by one into the document feeding passage, and at least one pair of register rollers for preventing skew of the document forwarding along the passage are arranged.

As illustrated in FIG. 1A by way of example, a conventional document feeder 1 applied to a stationary copying machine M having a transparent platen P defining a document reading portion R. This document feeder 1 comprises a document supply tray 2 on which one or more documents D are stacked, a document draw-out roller 3 disposed on the bottom of the document supply tray 2 for sending out the documents on the document supply tray 2 one by one, a document feed roller 5 around which a document feeding passage 4 extending from the document supply tray 2 to the document reading portion R is formed, one or more transport rollers 6 arranged in the document feeding passage 4, and paired registering rollers 7 being in contact with each other for correcting skew of the document forwarding aslant along the document feeding passage 4. This document feeder 1 is found in, for instance, Japanese Utility Model Application Public Disclosure No. SHO 63-35740(A).

When giving an image-processing instruction to the copying machine M, the lowermost one of the stacked documents D on the document tray 2 is sent into the document feeding passage 4 by rotating the draw-out roller 3 and forwarded by the rotating feed roller 5 and transport roller 6 until it collides with the registering rollers 7. Immediately after the document collides with the registering rollers 7, the registering rollers 7 so far stopped starts to rotate to advance the document toward the document reading portion R.

In some cases, the draw-out roller, feed roller 5 and registering rollers 7 in the document feeder are driven by independent driving means including electric motors 8 because these rotating elements should be driven with exquisite timing. Such a document feeder adopting a plurality of driving means enjoys an advantage in that the rotation transmission mechanism of its driving system can be made relatively simple but has the disadvantage that it adds to the size and weight.

In general, the document feeder has a driving and rotation transmitting system 9 including belts or gears as illustrated in FIG. 1B. However, this document feeder with such a driving and rotation transmitting system drives the rollers to rotate all at once during transporting the document, resulting in reduction of efficiency and occurrence of harsh noises. In the document feeder mentioned in Japanese Patent Publication No. SHO 62-5858(B) (corresp. to Japanese Patent Disclosure No. SHO 58-31837(A)), the feed roller 5 driven through an electromagnetic clutch 5*a* so as to be rotated only when the document comes into contact with the feed roller while advancing along the document feeding passage. Of course, the rotating transmission means for driving the registering rollers 7 incorporates an electromagnetic clutch 7*a* to temporarily stop the registering rollers 7.

In any case, during the forwarding of the document around the feed roller 5, one or more of the draw-out roller 3, transport roller 6 and registering rollers 7, which do not directly help the document to advance at that time, are rotated together with the rotating feed roller 5. Each roller is generally composed of a plurality of roller elements of the number in conformity with the width of the document reading portion of the image processing device. Therefore, it requires relatively large kinetic energy to rotate the respective rollers, resulting in generation of harsh noises during rotation. Thus, it is desirable to interrupt the rotation of the rollers which rotates, but do not exert the forward movement to the document.

However, this conventional document feeder having the electromagnetic clutchs, as illustrated in FIG. 1B, for temporarily stopping the rollers which do not serve to forward the document has a disadvantage of making the rotation transmitting mechanism and control system complicated and large in size and turning out to be expensive and susceptible to mechanical troubles during service.

OBJECT OF THE INVENTION

This invention is made to eliminate the drawbacks suffered by the conventional document feeding devices as described above and has an object to provide a high performance document feeding device capable of automatically feeding documents one by one to a document reading portion of an image processing device such as a copying machine and image reader with efficiency.

Another object of the invention is to provide an automatic document feeding device having a rational rotation transmission system capable of being controlled with ease, reduced in size and weight and manufactured inexpensively.

Still another object of the invention is to provide an automatic document feeding device capable of performing reliable sheet feeding operations of securely and silently sending out a single document from documents stacked on a document supply tray to a document feeding passage without double-feeding and skew.

SUMMARY OF THE INVENTION

To attain the object described above according to this invention, there is provided an automatic document feeding device comprising a reversible electric motor, a document feed roller around which a document feeding passage is formed, a first one-way clutch disposed between the motor and the feed roller for transmitting a rotary motion from the motor to the feed roller only when the motor rotates in a positive direction, registering rollers disposed in the document feeding passage, and a second one-way clutch disposed between the motor and the registering rollers for transmitting a rotary motion from the motor to the registering rollers only when the motor rotates in a negative direction.

The document to be processed in an image processing device is first transferred along the document feeding passage by causing the document feed roller to rotate by driving the reversible electric motor in the positive direction. At this time, the registering rollers stop rotating because the second one-way clutch is in the disconnected state the motor rotates in the positive direction.

Just after the document advancing along the feeding passage collides with the registering rollers, the electric motor is reversed, thereby to disconnect the first one-way clutch and joint the second one-way clutch. As a result, the feed roller stops rotating, and simultaneously, the registering rollers start to rotate, thus forwarding the document upon correcting the skew of the document.

Since the document feed roller and registering rollers can selectively be operated merely by selecting the direction in which the electric motor rotates, the document can be forwarded reliably, rationally and silently from the document supply tray to the document reading portion without a specific control system for the two one-way clutches.

Other and further objects of this invention will become obvious upon an understanding of the illustrative embodiments about to be described or will be indicated in the appended claims, and various advantages not referred to herein will occur to one skilled in the art upon employment of the invention in practice.

DESCRIPTION OF THE PREFERRED EMBODIMENTS

The present invention will become more fully understood from the detailed description given hereinbelow and the accompanying drawings which are given by way of illustration only, and thus are not, limitative of the present invention.

The document feeding device according to the present invention is adapted for automatically feeding documents one by one to a document reading portion in an image processing device. Although the document feeder of this invention may be applied to any sort of the image processing devices such as a copying machine, image reader and facsimile, an explanation will be made hereinafter as to the document feeding device applied to the copying machine by way of example, but this should not be understood as limitative.

Figure 1A:
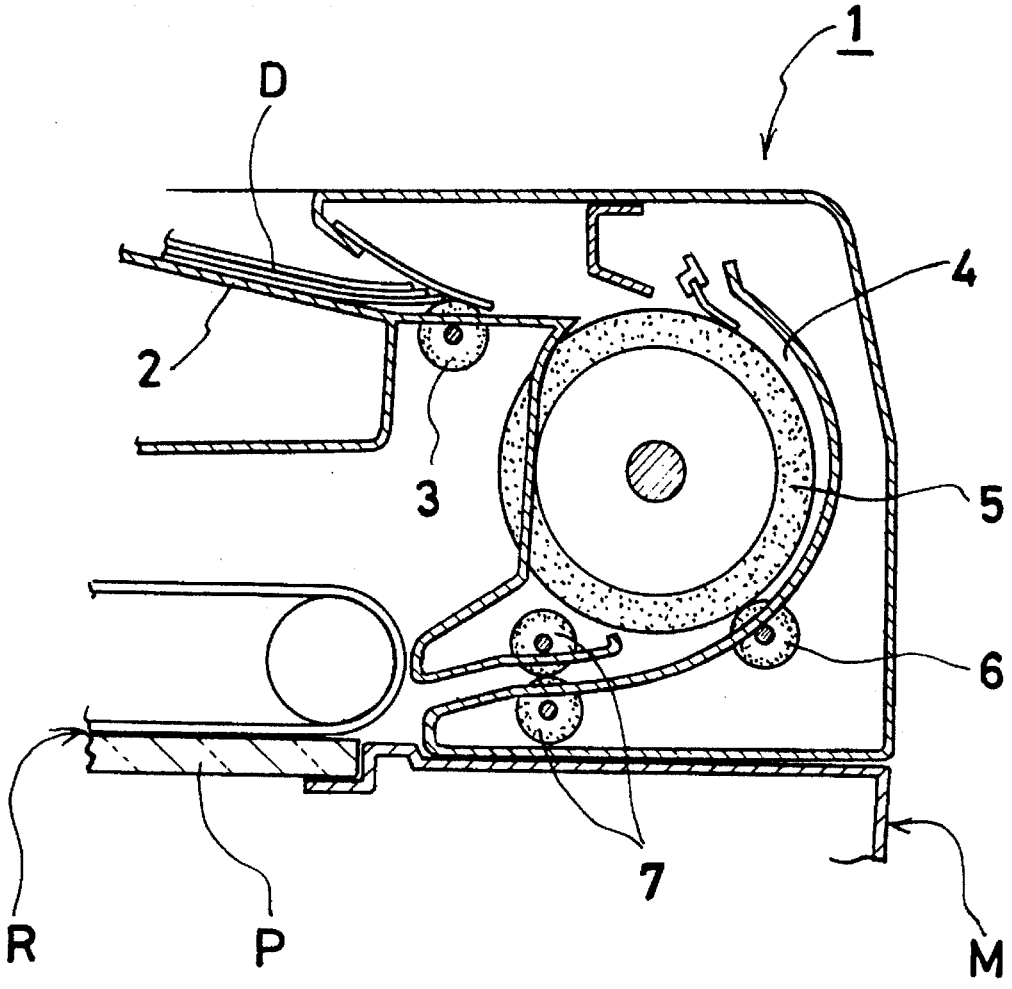
FIG. 1A PRIOR ART
FIG. 1A and FIG. 1B are side section and perspective view schematically showing one part of a prior art document feeder.
Figure 1B:
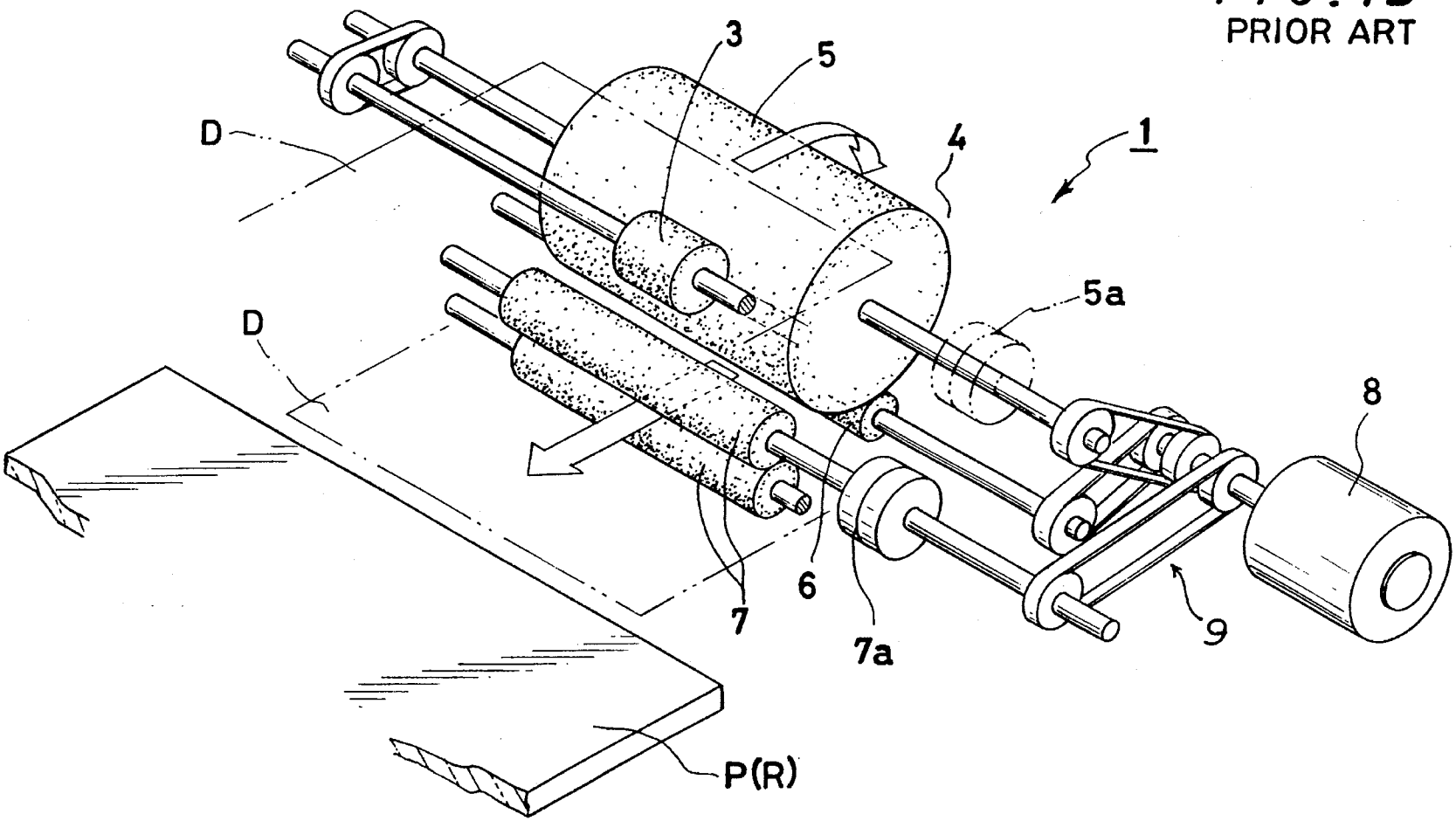
FIG. 1B PRIOR ART
Figure 2:
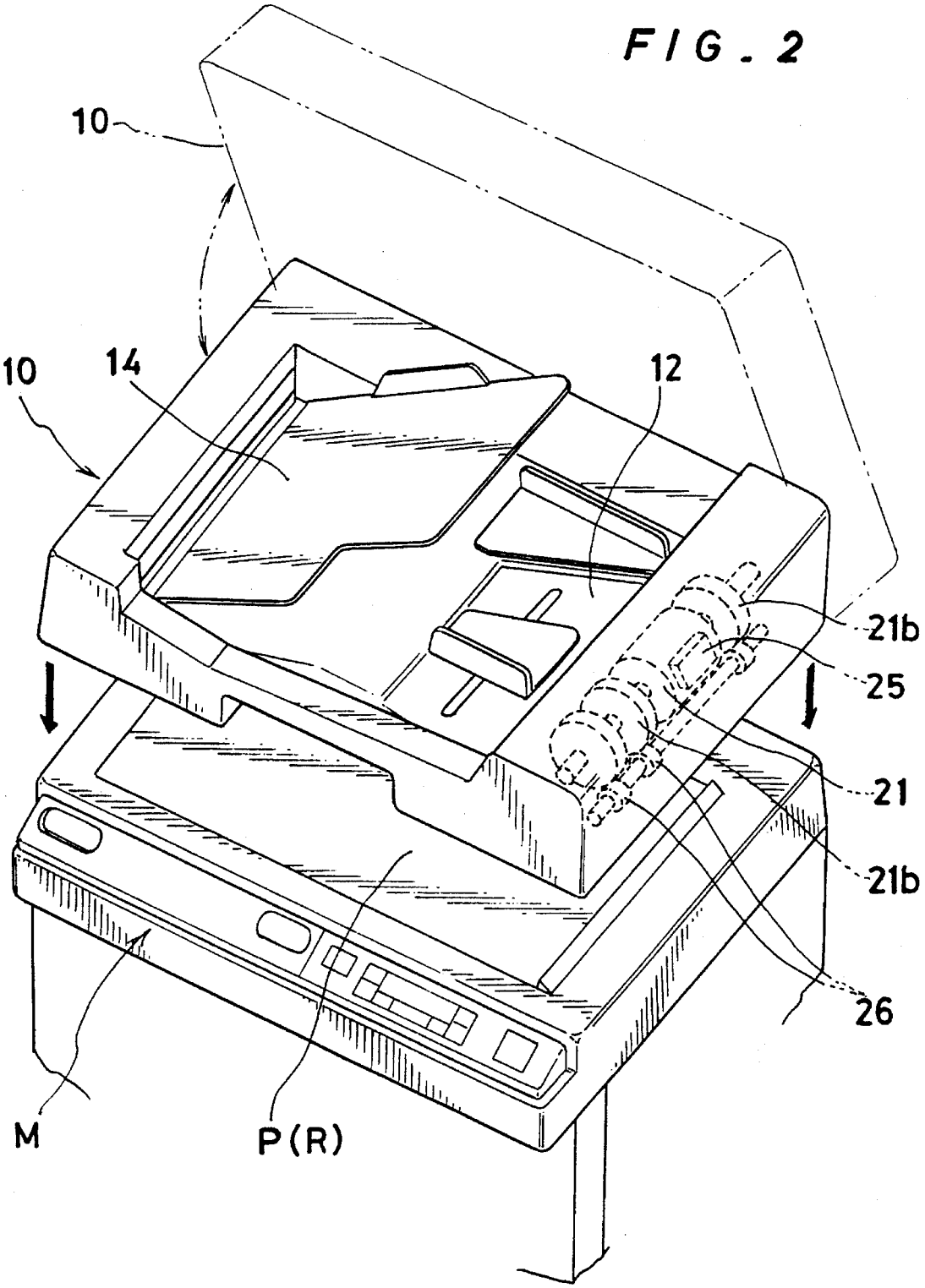
FIG. 2 is a schematic perspective view showing one embodiment of the automatic document feeding device according to this invention.

As illustrated in FIG. 2, the document feeding device 10 of this invention is mounted on the top of the copying machine M so as to cover a document reading portion R defined on a transparent platen P. The document feeding device 10 is hinged on the copying machine M in the openable state above the copying machine as indicated by the imaginary-line arrow in FIG. 2, so that a document to be processed in the image processing copying machine can be manually placed on the platen P.

Figure 3:
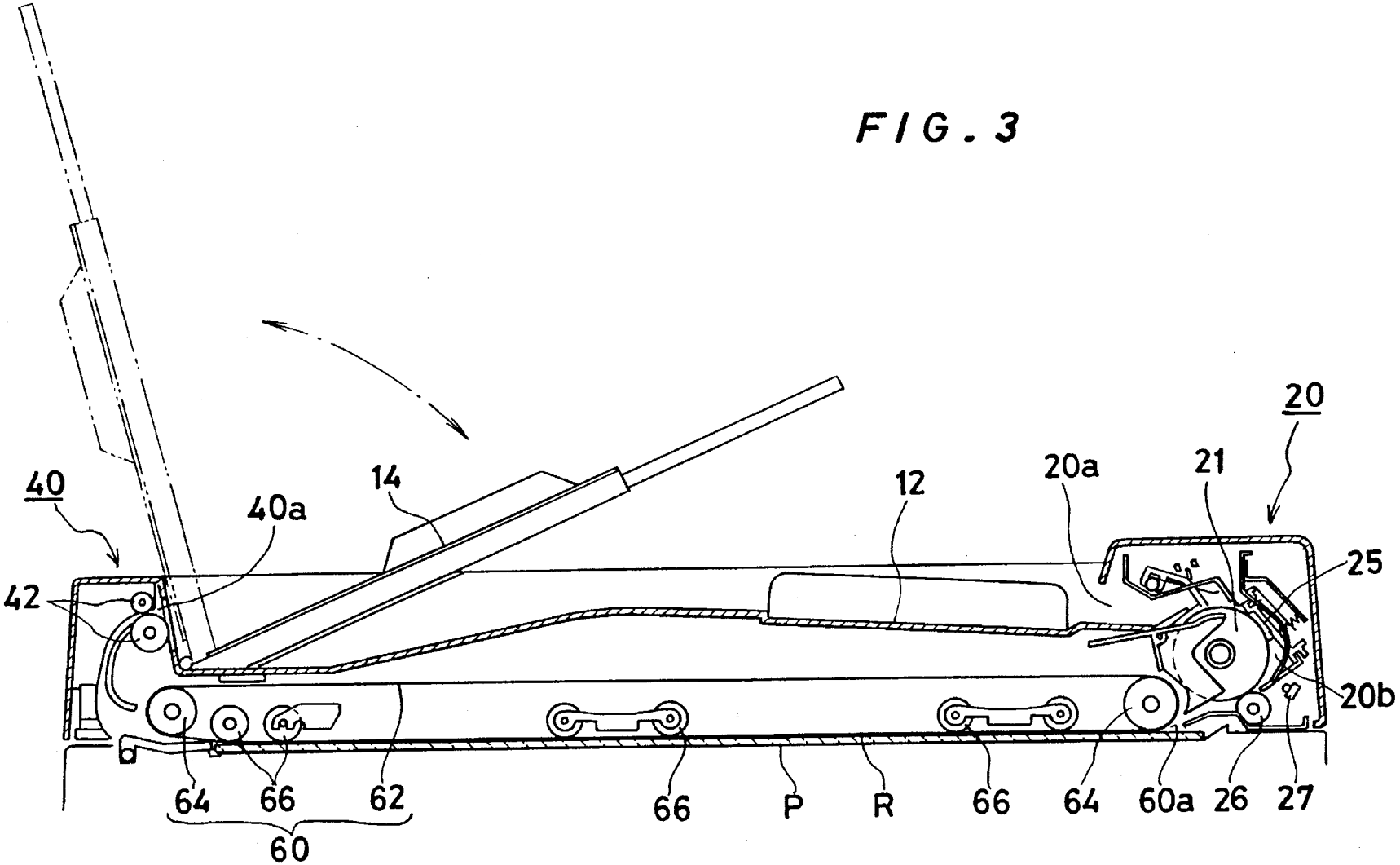
FIG. 3 is a schematic side section showing the device of FIG. 2.

As shown in FIG. 3, the document feeding device 10 comprises a document feed unit 20 on one side thereof, a document discharge unit 40 on the other side thereof, and a transport unit 60 located between the document feed unit 20 and the document discharge unit 40. The document reading portion R is substantially covered with the transport unit 60. Above the transport unit 60, there are located a document supply tray 12 integrally connected to a document entrance 20*a* of the document feed unit 20, a document discharge tray 14 integrally connected to a document exit 40*a* of the document discharge unit 40. One or more documents D to be processed are stacked on the document supply tray 12, and forwarded to the document discharge tray 14 via the document feed unit 20, document reading portion R covered with the transport unit 60, and the document discharge unit 40.

The document supply unit 20 in this embodiment has a document feed roller 21 having a circumferential surface which partially forms a document feeding passage 20*b* extending from the document entrance 20*a* to a junction between the document feed unit 20 and the document reading portion R. Along the document feeding passage 20*b* formed around the feed roller 21, there are arranged an empty sensor 22 for detecting the document or documents on the document supply tray 12, a pressure member 23 for holding down the documents on the document supply tray 12, a document stopper 24, document separation means 25 for preventing double-feed of the documents, and at least one registering roller 26 for performing skew correction.

Between the separation means 25 and the registering roller 26, a document sensor 27 composed of a photocoupler or other possible sensing means is disposed in front of and near the registering roller 26.

Prior to giving an image processing or copying instruction to the copying machine M, one or more documents D are put on the document supply tray 12 until the leading ends of the documents collide with the document stopper 24.

The document feed roller 21 is supported by a rotating shaft 21*a* and have a circumferential surface relatively large in frictional coefficient. The feed roller 21 may be formed of rubber or other plastic material. Thus, the document coming in contact with the feed roller 21 is frictionally fed with the rotation of the feed roller 21.

Figure 5:
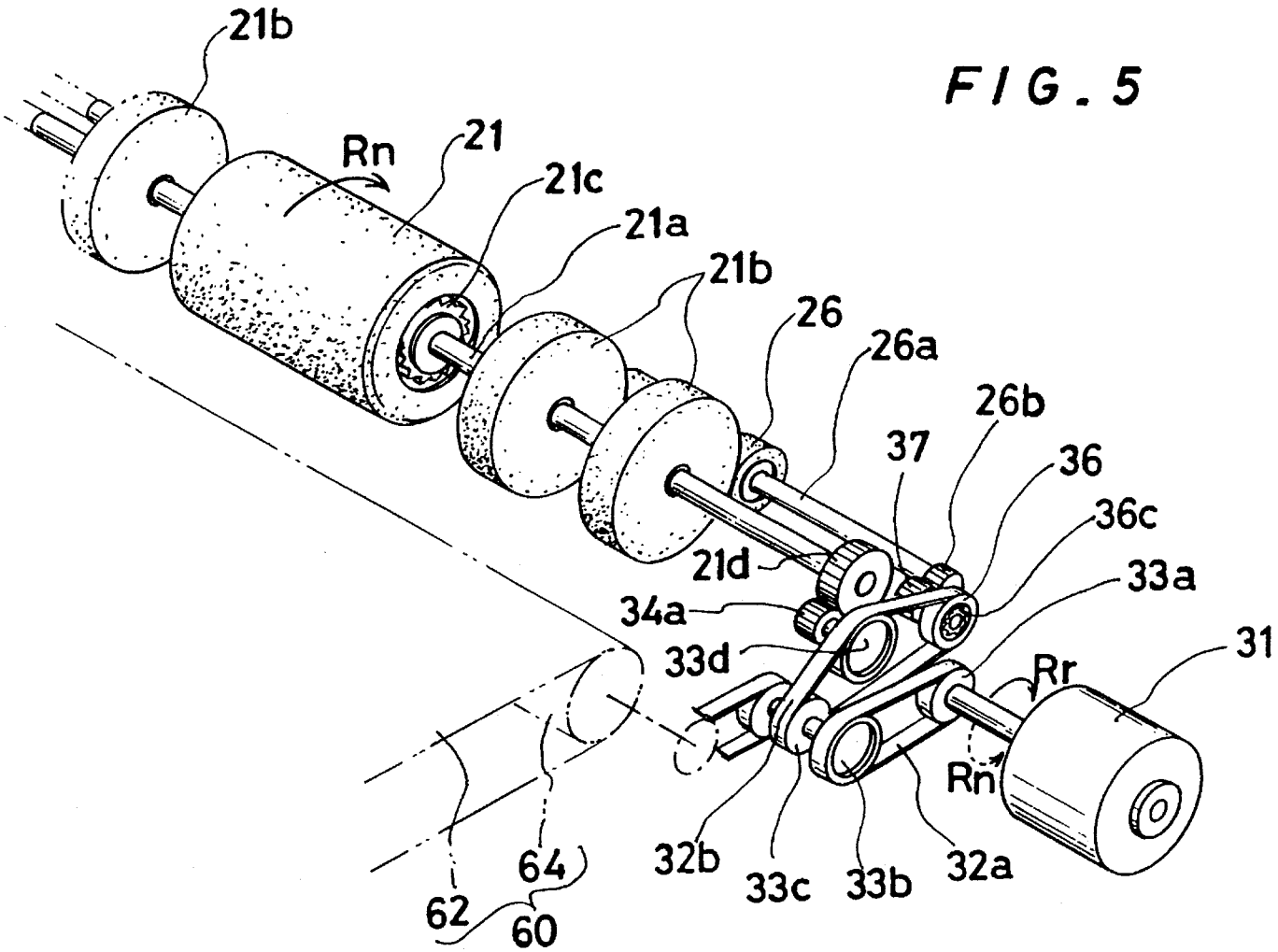
FIG. 5 is a schematic perspective view showing one example of a driving system in the document feeding device of this invention.

As schematically shown in FIG. 5, at least one idle roller 21*b* is free-rotatably supported by the rotating shaft 21*a* so as to rotate independently of the rotating shaft 21*a* and in frictional contact with the registering roller 26 supported by a rotating shaft 26*a* parallel to the rotating shaft 21*a* on which the feed roller 21 is retained. It is desirable to dispose one or more idle rollers 21*b* on either side of the feed roller 21.

The frictional coefficient of the circumferential surface of the idle roller 21*b* is made smaller than that of the respective document feed roller 21 and registering roller 26.

The document feed roller 21 in this embodiment incorporates a one-way clutch 21*c*. The one-way clutch 21*c* has a function of transmitting a rotary motion of the rotating shaft 21*a* to the feed roller 21 when the shaft 21*a* rotates in a positive or normal direction, and preventing the rotary motion of the shaft 21*a* from being transmitted to the feed roller 21 when the shaft 21*a* rotates in a negative or reverse direction.

The aforesaid empty sensor 22 is rotatably supported by an axis 22*a* and can detect the document or documents stacked on the document supply tray 12 by finding the angle at which a sensor lever thereof is inclined. That is, when the sensor lever of the sensor 22 assumes the posture indicated by the imaginary line in FIG. 4, no document is deemed to exist on the tray 12, and then, the copying machine M and the document feeding device 10 may be kept in its inoperative state.

Figure 4:
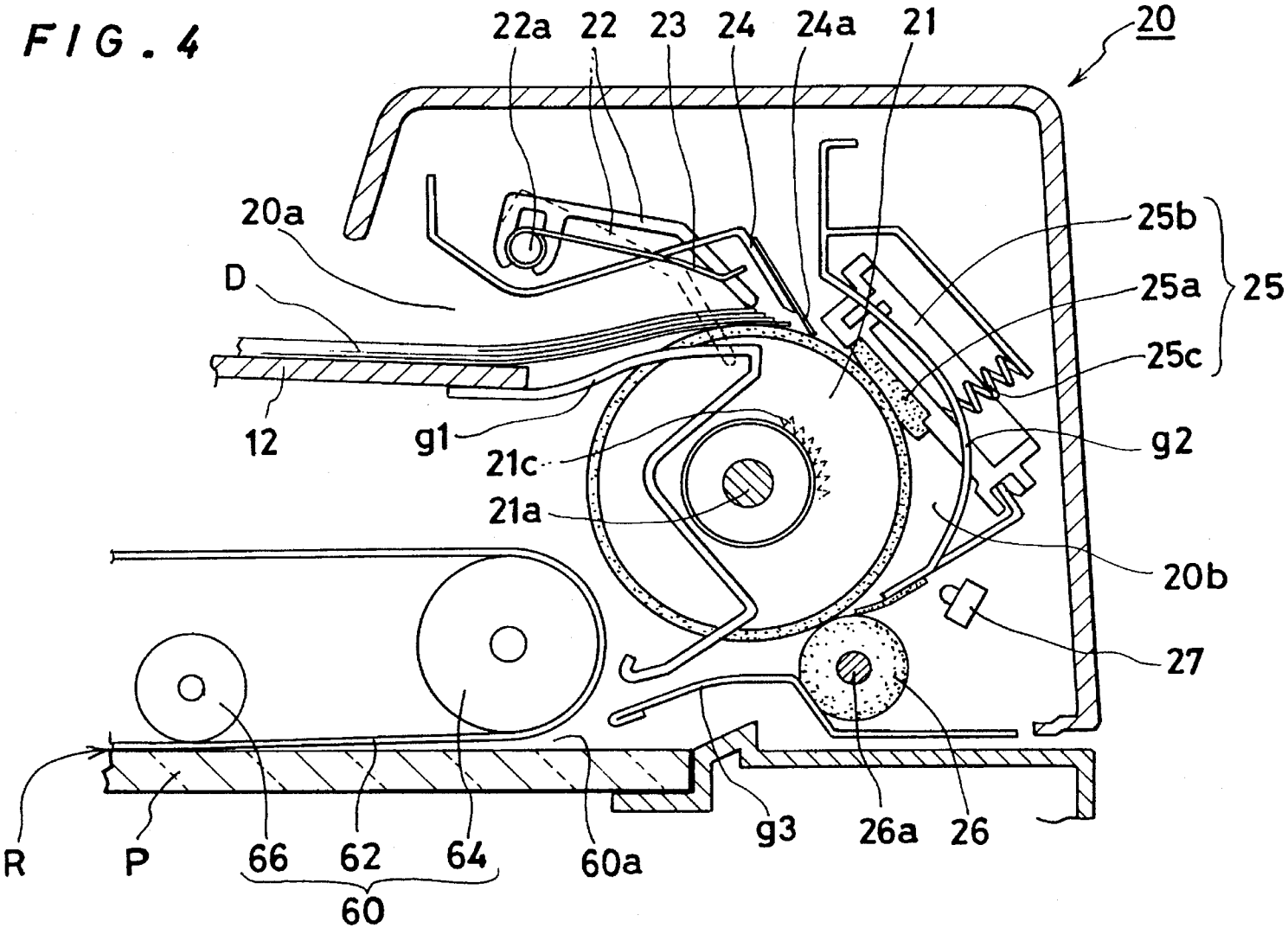
FIG. 4 is an enlarged side section schematically showing the device of FIG. 3.

The pressure member 23 is also pivoted on the axis 22*a* and kept upward in the inoperative state of the feeding device 10 as shown in FIG. 4. When a copying instruction is given to the copying machine M, the pressure member 23 comes down to press the document or documents on the supply tray 12 against the document feed roller 21. As a result, the friction between the lowermost document on the supply tray 12 and the feed roller 21 is increased, thereby to enable the lowermost document to be securely sent out toward the document feeding passage 20*b* with rotation of the feed roller 21.

The document stopper 24 includes a resilient member 24*a* such as of a plastic sheet or plate. The resilient member 24*a* comes into light contact with or narrowly separated from the feed roller 21 so as to permit only one document to pass between the document stopper 24 and the feed roller 21.

Furthermore, the document stopper 24 has a lower end somewhat lower than the horizontal line tangential to the feed roller 21 and above the axial center of the feed roller 21 so as to make the document or documents difficult to enter unexpectedly into the document feeding passage 20*b* over the document stopper 24.

The document separation means 25 comprises a friction pad 25*a* made of rubber or other frictional material, a holder 25*b* for retaining the frictional pad 25*a*, and a spring 25*c* for urging the frictional pad 25*a* against the feed roller 21. With this document separation means 25, even if two or more documents pass between the document stopper 24 and the feed roller 21, only one document is permitted to pass between the document separation means 25 and the feed roller 21 and the remaining documents are prevented from passing. Thus, double-feed of the documents can be securely prevented.

The aforementioned at least one registering roller 26 is disposed opposite to the document feed roller 21 astride the document feeding passage 20*b* and rotates to forward the document along the passage 20*b* in the direction opposite to that in which the feed roller 21 rotates to forward the document.

The registering roller 26 is supported by a rotating shaft 26*a* and is made of frictional material such as rubber. This registering roller 26 comes into frictional contact with the idle roller 21*b* free-rotatably supported by the rotating shaft 21*a*. Practically, plural sets of the registering rollers and idle rollers may be used. In the case of using the plural sets of rollers, the registering rollers and idle rollers are arranged in pairs on the parallel rotating shafts 21*a* and 26*a* in such a state that the contact points of these registering rollers and idle rollers form a straight line perpendicular to the direction in which the document is forwarded.

The registering rollers 26 stop rotating until the document being fed over the document separation means 25 arrives at the contact point between the registering rollers 26 and idle rollers 21*b* or collides with the registering rollers 26. At the moment that the document comes into collision with the registering rollers 26, the document is slightly bent, thereby to bring the entire leading edge of the document into close contact with all the contact points of the registering rollers and idle rollers. Consequently, the leading edge of the document assumes the exact right angle to the document forwarding direction. Thus, skew-correction can be achieved.

Just after the document collides with the registering rollers 26, the registering rollers 26 start rotating to forward the document toward the junction 60*a* between the document feeding unit 20 and the transport unit 60 (document reading portion R.

Timing for switching the operative or inoperative states of the feed roller 21 and registering rollers 26 is determined in accordance with the signals issued from the document sensor 27. To be more specific, at a specified time after the document sensor 27 detects the leading end of the document forwarded along the document feeding passage 21*b*, the document feed roller 21 is stopped. That is, the document feed roller 21 and registering rollers 26 are controlled so that the feed roller 21 is stopped just after the document collides with the registering rollers 26, and then, immediately after the feed roller 21 stops, the registering rollers 26 start rotating.

A driving system 30 including rotation transmitting means in the device of this invention is shown in an easily understandable manner in FIG. 5.

The driving system 30 comprises a reversible electric motor 31 capable of selectively moving in opposite directions. The rotary motion produced by the motor 31 is transmitted to the rotating shaft 21*a* supporting the feed roller 21 through belts 32*a* and 32*b*, pulleys 33*a*–33*d*, and gears 34*a* and 21*d*. Since the feed roller 21 incorporates the one-way clutch 21*c* which transmits the rotary motion of the rotating shaft 21*a* to the feed roller 21 only when the shaft 21*a* rotates in the positive or normal direction as touched upon above, the feed roller 21 rotates in the normal direction (Rn) in which the document is forwarded.

On the other hand, the rotary motion from the motor 31 is transmitted to the rotating shaft 26*a* through the belt 32*b*, pulley 36, gear 37 and gear 26*b*. Since the pulley 36 incorporates the one-way clutch 36*c* which transmits the rotary motion from the motor 31 to the rotating shaft 26*a* only when the motor 31 rotates in the negative or reverse direction, the registering roller 26 rotates in the negative or reverse direction (Rr), thus advancing the document.

Next, the operation principle of the driving system 30 will be described with reference to FIGS. 6A–6C. In the drawings, the principal elements such as the belts and pulleys constituting the rotation transmitting means of the driving system 30 are omitted for brevity's sake. Moreover, although the one-way clutches 21*c* and 36*c* are incorporated within the feed roller 21 and the pulley 36 in this embodiment as described above, these one-way clutches are conceptually illustrated in FIGS. 6A–6C.

Figure 6A:
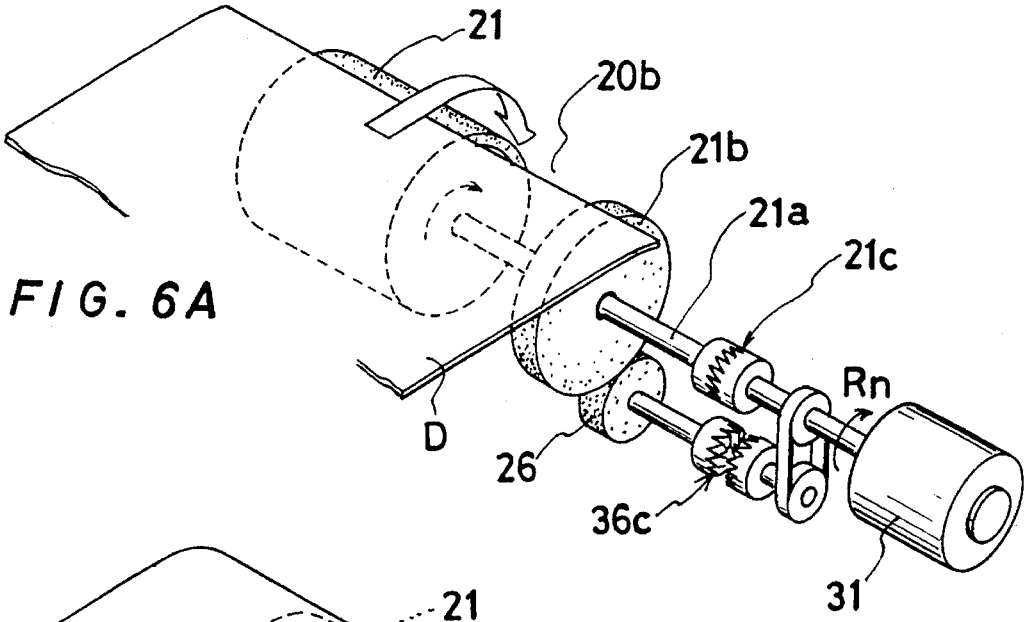
FIG. 6A through FIG. 6C are explanatory diagrams showing the operating principle of the document feeding device of this invention.

When a copying instruction is first given to the copying machine M, the motor 31 starts to rotate in the positive direction Rn as illustrated in FIG. 6A. When motor 31 rotates in the positive direction Rn, the first one-way clutch 21*c* assumes its joined state, thus transmitting the rotary motion from the motor 31 to the feed roller 21. As a result, the document D is sent into the document feeding passage 20*b* around the feed roller 21. At this time, the second one-way clutch 36*c* assumes its disconnected state, and therefore, the registering roller 26 is at rest.

Figure 6B:
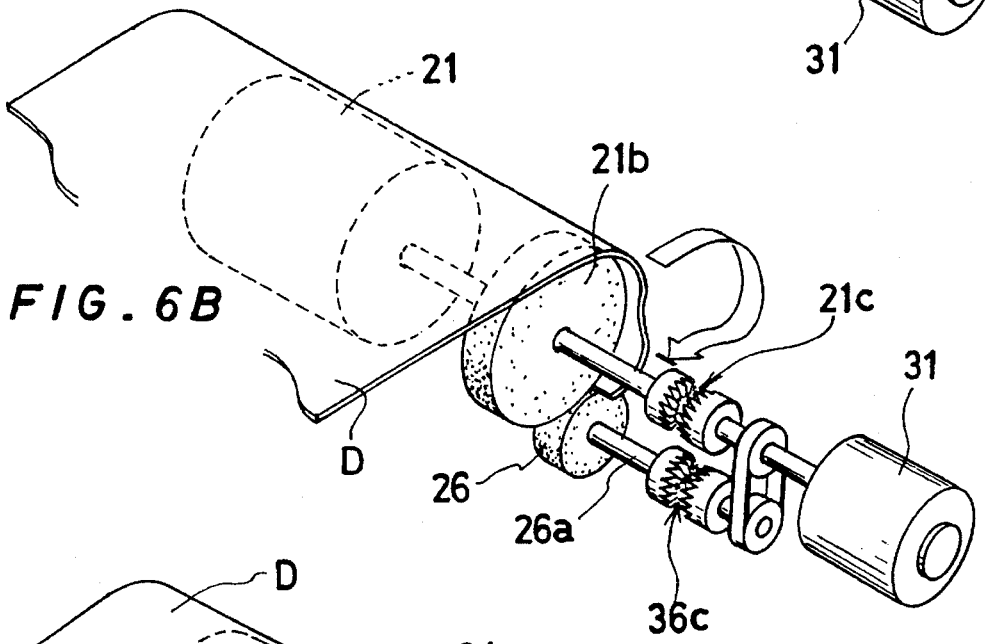
Figure 6C:
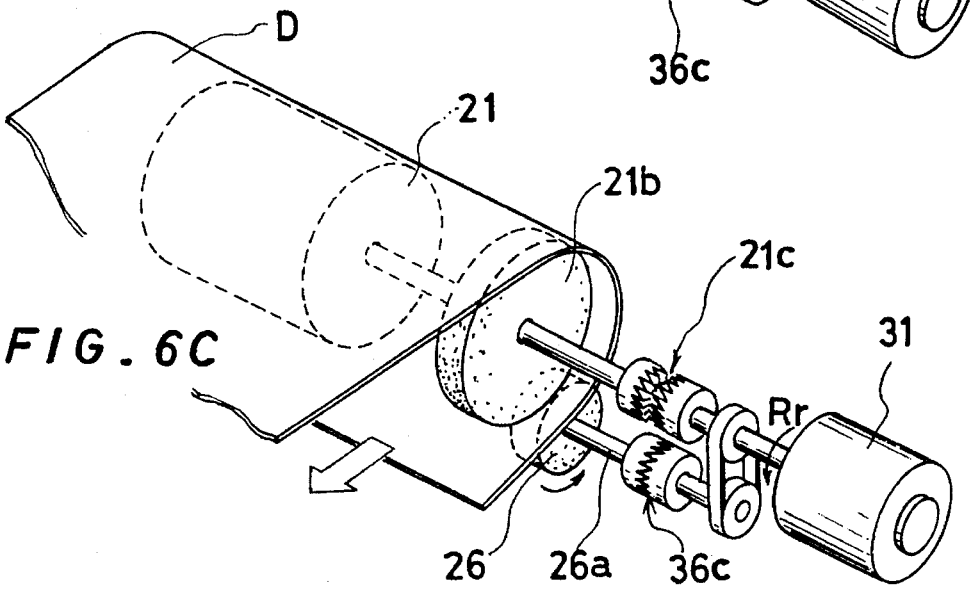

The document D is advanced along the document feeding passage 20*b* until the leading end of the document collides with the registering roller 26 as illustrated in FIG. 6B. Just after the document collides with the registering roller 26, the motor 31 stops. As a result, the document is slightly bent, as conceptually depicted by the wide arrow, so as to make the leading end of the document perpendicular to the document forwarding direction even if the document is aslant (skew-correction).

Then, just after the motor stops, it starts to rotate in the reverse direction Rr. When the motor is reversed, the first one-way clutch 21*c* is disconnected to bring the feed roller 21 to a halt, and simultaneously, the second one-way clutch 36*c* is joined to transmit the rotary motion of the motor 31 to the registering roller 26 as shown in FIG. 6C. Consequently, the registering roller 26 rotates in the negative direction, i.e. document forwarding direction. Therefore, the document D is advanced through between the registering roller 26 and idle roller 21*b* as depicted by the wide arrow in FIG. 6C.

As described above, by selectively driving the motor 31 in the normal or reverse direction, either of the feed roller 21 and registering roller 26 can be rotated to move the document forwardly. Thus, when one of the feed roller 21 and the registering roller 26 rotates, the other roller stops rotating. That is to say, the minimum number of rollers may be operated in the device of this invention, and the elements which are not necessarily required for advancing the document are stopped temporarily. The irregular rotational operations of the rollers can be reliably performed with efficiency by selectively activating the two one-way clutches.

Thereafter, the document, which is sent to the junction 60*a* between the document feeding unit 20 and the transport unit 60 in the manner as mentioned above, is introduced into the document reading portion R and further forwarded by means of the transport unit 60 constituted by an endless belt 62, pulleys 64 and pressure rollers 66 as illustrated in FIG. 3, and brought to a prescribed place in the document reading portion R on the platen P. After the document is processed on the platen P, it is discharged to the discharge tray 14 through the document exit 40*a* by rotating a document discharge roller 42 of the document discharge unit 40. Since the document discharge unit 40 and transport unit 60 are commonly found in a conventional document feeder of this type, these units are not explained in detail herein.

The document feed roller 20 and separation means 25 are not necessarily located at the center relative to the width of the feeder 10, and may be brought somewhat near one longitudinal side of the feeder 10 in conformity with the structure of the copying machine M in which the documents to be processed are placed on the document reading portion P so that one longitudinal side of the document comes in contact with one longitudinal side (the rear side in FIG. 2) of the document reading portion R.

As is apparent from the foregoing description, according to the present invention, the document feed roller for forwarding a document in the first period and the registering roller for performing skew-correction and forwarding the document in the second period can be effectively operated by use of the first and second one-way clutches which are selectively activated by actuating the reversible motor in opposite directions. Thus, the document feeder according to this invention has a highly reliable, rational and silent mechanism that makes the system compact and lightweight.

That is, this invention can provide a high performance document feeding device capable of automatically feeding documents one by one to a document reading portion of an image processing device such as a copying machine and image reader with efficiency.

It is to be understood that the invention is not limited in its application to the details of construction and arrangement of parts illustrated in the accompanying drawings, since the invention is capable of other embodiments and of being practiced or carried out in various ways. Also it is to be understood that the phraselogy or terminology employed herein is for the purpose of description and not of limitation.

What is claimed is:

1. An automatic document feeding device mounted to an image processing device having a document reading portion, which comprises a document feed unit having a document supply tray on which one or more documents are stacked, said document feed unit being adapted to send out the documents one by one from said document supply tray, a document transport unit placed on the document reading portion of said image processing device for bringing said document sent from said document feed unit to said document reading portion for processing, and a document discharge unit having a document discharge tray for discharging said document from said document reading portion to said document discharge tray, said document feed unit including:

a reversible electric motor for selectively producing a rotary motion in a positive or negative direction, a document feed roller supported by a first rotating shaft, which rotates in a positive direction to forward the document sent from said document supply tray, a document feeding passage formed around at least one part of said document feed roller, a first one-way clutch disposed on said first rotating shaft for transmitting said rotary motion of said motor to said feed roller only when said motor rotates in a positive direction, at least one idle -roller free-rotatably supported on said first rotating shaft, at least one registering roller supported by a second rotating shaft parallel to said first rotating shaft and being in contact with said at least one idle roller, which rotates in the negative direction to forward the document just after said document being fed along said document feeding passage arrives at said at least one registering roller, and a second one-way clutch for transmitting a rotary motion of said motor to said at least one registering roller only when said motor rotates in a negative direction.

2. A device according to claim 1, wherein said first one-way clutch is incorporated in said document feed roller.

3. A device according to claim 1, further comprising a document sensor disposed in front of and near said registering roller for detecting the document advancing along said document feeding passage so as to permit said motor to continue rotating in the positive direction until said document sensor detects the document, and reverse said motor just after said document sensor detects the document.

4. A device according to claim 1, wherein one or more of said idle rollers are disposed on either side of said document feed roller.

5. A device according to claim 1, wherein said idle roller has a circumferential surface smaller in frictional coefficient than that of said document feed roller and registering roller.

6. A device according to claim 1, further comprising an empty sensor for detecting the document or documents on said document supply tray, a pressure member for holding down the documents on said document supply tray, and document separation means for preventing double-feed of the documents, which are arranged along said document feeding passage.

7. A device according to claim 6, wherein said document separation means comprises a friction pad in contact with said document feed roller so as to permit only one document to pass therebetween, a holder for retaining the frictional pad, and a spring for urging the frictional pad against the document feed roller.

8. An automatic document feeding device according to claim 6, wherein documents are fed in a longitudinal direction and said document feed roller and said document separation means are disposed near one longitudinal side of the document feeding device, said document feeding device and said image processing device in which the document to be processed is placed on the document reading portion being aligned so that one longitudinal side of the document comes in contact with one longitudinal side of said document reading portion.

9. A device according to claim 6, further comprising a document stopper for permitting one of the documents stacked on said document supply tray to advance to prevent double-feed.

10. A device according to claim 9, wherein said document separation means comprises a friction pad in contact with said document feed roller so as to permit only one document to pass therebetween, a holder for retaining the frictional pad, and a spring for urging the frictional pad against the document feed roller.

11. A device according to claim 9, wherein said document stopper has a lower end somewhat lower than a horizontal line tangential to said document feed roller and above said first rotating shaft.

* * * * *